US006343998B1

(12) United States Patent
Tarulli et al.

(10) Patent No.: US 6,343,998 B1
(45) Date of Patent: Feb. 5, 2002

(54) GOLF SWING PRACTICE APPARATUS

(76) Inventors: Joseph Leonard Tarulli; Joseph Paul Ingarra, both of 52 First St., Garden City, NY (US) 11530

( * ) Notice: Subject to any disclaimer, the term of this patent is extended or adjusted under 35 U.S.C. 154(b) by 0 days.

(21) Appl. No.: 09/412,527

(22) Filed: Oct. 5, 1999

(51) Int. Cl.[7] ..... A63B 53/06
(52) U.S. Cl. ..... 473/273
(58) Field of Search ..... 473/266, 271, 473/272, 273, 276, 417, 422, 459, 462, 429, 449, 149; 248/145, 165, 127, 158; 119/786; D6/457, 458; 273/440, 449; 482/87, 148

(56) References Cited

U.S. PATENT DOCUMENTS 1,936,143 A * 11/1933 Shea ..... 473/273
2,794,554 A * 6/1957 Donner ..... 248/145
3,138,388 A * 6/1964 Herold ..... 473/273
3,861,679 A * 1/1975 Culpepper ..... 473/429
4,047,605 A 9/1977 Rosenvold ..... 194/1 R
4,758,000 A 7/1988 Cox ..... 273/190 R
5,156,401 A 10/1992 Hodgkiss ..... 273/186.2
6,159,111 A * 12/2000 Purcell ..... 473/422

* cited by examiner

*Primary Examiner*—Mark S. Graham
*Assistant Examiner*—Raeann Gorden
(74) *Attorney, Agent, or Firm*—Goldstein Law Offices, P.C.

(57) ABSTRACT

A golf swing practice apparatus for allowing a golfer to, practice his golf swing with a golf club. The golf swing practice apparatus comprises an elongated housing having a bottom edge, a tripod stand mounted near the bottom edge of the housing, a vertical rod mounted within the housing so that the rod extends upward from the housing, an extension pivotably mounted to the rod at its the center and a pair of swing arms pivotably mounted from the ends of the extension so that the swing arms may be extended at a right angle therefrom.

12 Claims, 3 Drawing Sheets

GOLF SWING PRACTICE APPARATUS

FIELD OF THE INVENTION

The invention relates to a golf swing practice apparatus. More particularly, the invention relates to an apparatus that facilitates a golfer in practicing his posture and swing routine while hitting a golf ball with a golf club.

BACKGROUND OF THE INVENTION

Golf is popular as a leisure activity that enables men and women, young and old, and children and adults to participate and compete in a sport that does not require raw physical strength. Many people enjoy golfing as a means for escaping from their hectic work and personal routines, and relaxing themselves. Unfortunately, golf is not an easy game to master, and one must spend considerable time practicing their golf swings to become proficient.

Success with golf is heavily dependent on one's ability to hit the ball such that it travels the desired distance, and in the desired direction. As a result, one must be able to control their golf swing such that they are can maintain guide the golf ball appropriately. Improving one's golf swings not only requires practice, but also a disciplined approach towards swinging the golf club. As is well known to most golfers, ability to swing the golf club correctly requires the player to maintain a proper posture while the club is in a swinging motion.

Many have suggested devices that facilitate golf swing practice. The general aim of these devices is to enable a player to perfect his stance for appropriately hitting the golf ball, such that the ball lands in the desired location on the "green". It is generally considered that the correct swing is performed in a plane, called the swing plane. It must be noted that one's swing plane may differ from that of another golfer. As a result, there are a variety of rules to improve one's stance and body alignment to achieve the correct swing.

During a golf game many different strokes are made, often under less than ideal conditions. Unfortunately, poor conditions while playing golf create additional variables which impact the consistency of a golfer's game. As a result, if a golfer is able to maintain a continuous swing and firm posture, he may be able to reduce the number of variables and achieve more consistent results. The typical prior art apparatus for guiding players is a circular guide for a club head that is secured in a fixed swing plane, and the player practices his swing by swinging the club head within the given swing plane. For example, U.S. Pat. No. 4,047,605 to Rosenvold discloses an apparatus for practicing golf swings, wherein the apparatus has a golf club that is secured in a fixed swing plane. This prior art mechanism suffers from the drawback that the club head is mounted by the apparatus, which prevents the player from experiencing the feel of freely swinging the golf club.

To overcome the disadvantages of a club head secured in an apparatus with a fixed swing plane, some have suggested devices that merely guide a player in maintaining the appropriate posture while swinging the golf club. For example, U.S. Pat. No. 4,758,000 to Cox discloses a practice apparatus for positioning a golfer in a golf stance and for guiding the golfer's body through a golf swing.

Even though the goal of these prior art devices is to provide a mechanism for improving one's golf swing, these devices fail to simulate the real experience of swinging a golf club for hitting the ball. Additionally, the prior art devices have complicated structures and are expensive in construction. Therefore, while the prior art units may be suitable for the particular purpose employed, or for general use, they would not be as suitable for the purposes of the present invention as disclosed hereinafter.

SUMMARY OF THE INVENTION

It is an object of the present invention to provide a golf swing practice apparatus.

It is another object of the present invention to provide an apparatus that guides a golfer in practicing his posture, motion and swing routines while freely hitting a golf ball, Accordingly, the present invention discloses a golf swing practice apparatus which comprises a pair of horizontal arms. To guide his swing, the golf ball is placed near the apparatus and the golfer's head lies between the horizontal arms. As is well known, a proper golf swing can only be achieved when the swing is within a given plane, which is achieved when the golfer swings without jerking his body or excess movement. Thus, the present invention forces the golfer to swing his club in a smooth continuous semi-circular motion to avoid hitting the horizontal arms with his head or shoulders.

It is yet a further object of the present invention to provide a golf swing practice apparatus that is portable and easy to store. Accordingly, the present invention discloses a golf swing practice apparatus that comprises a hollow housing, wherein the entirety of the apparatus may he collapsed together and secured in the housing.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims and their legal equivalents.

BRIEF DESCRIPTION OF THE DRAWINGS

The above and other aspects, features and advantages of the present invention will be more apparent from the following detailed description thereof, which is presented in conjunction with the following drawings, wherein corresponding reference characters indicate corresponding components throughout the drawing figures.

DETAILED DESCRIPTION OF THE PREFERRED EMBODIMENTS

Figure 1:
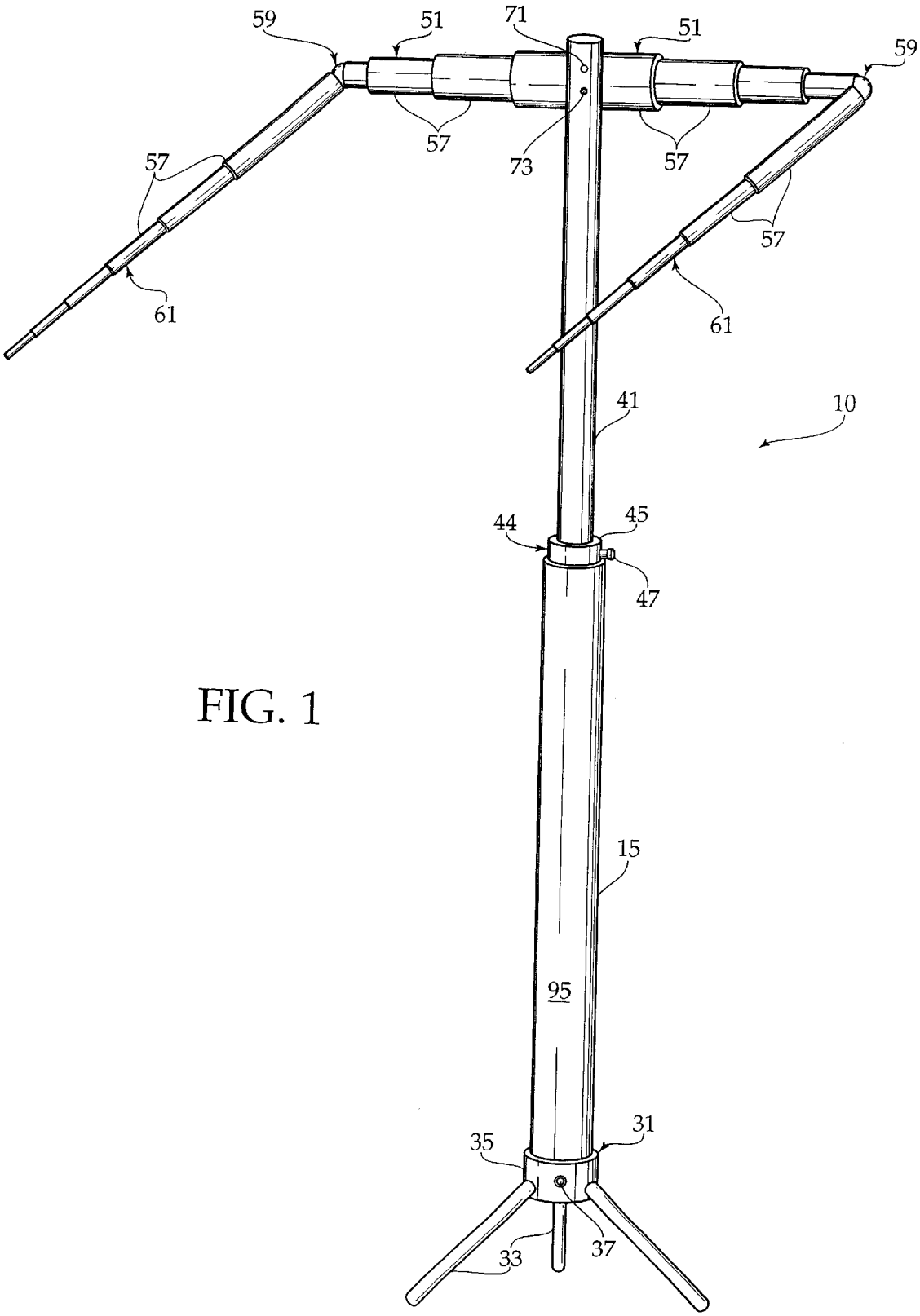
FIG. 1 is a diagrammatic perspective view of the golf swing practice apparatus.
Figure 2:
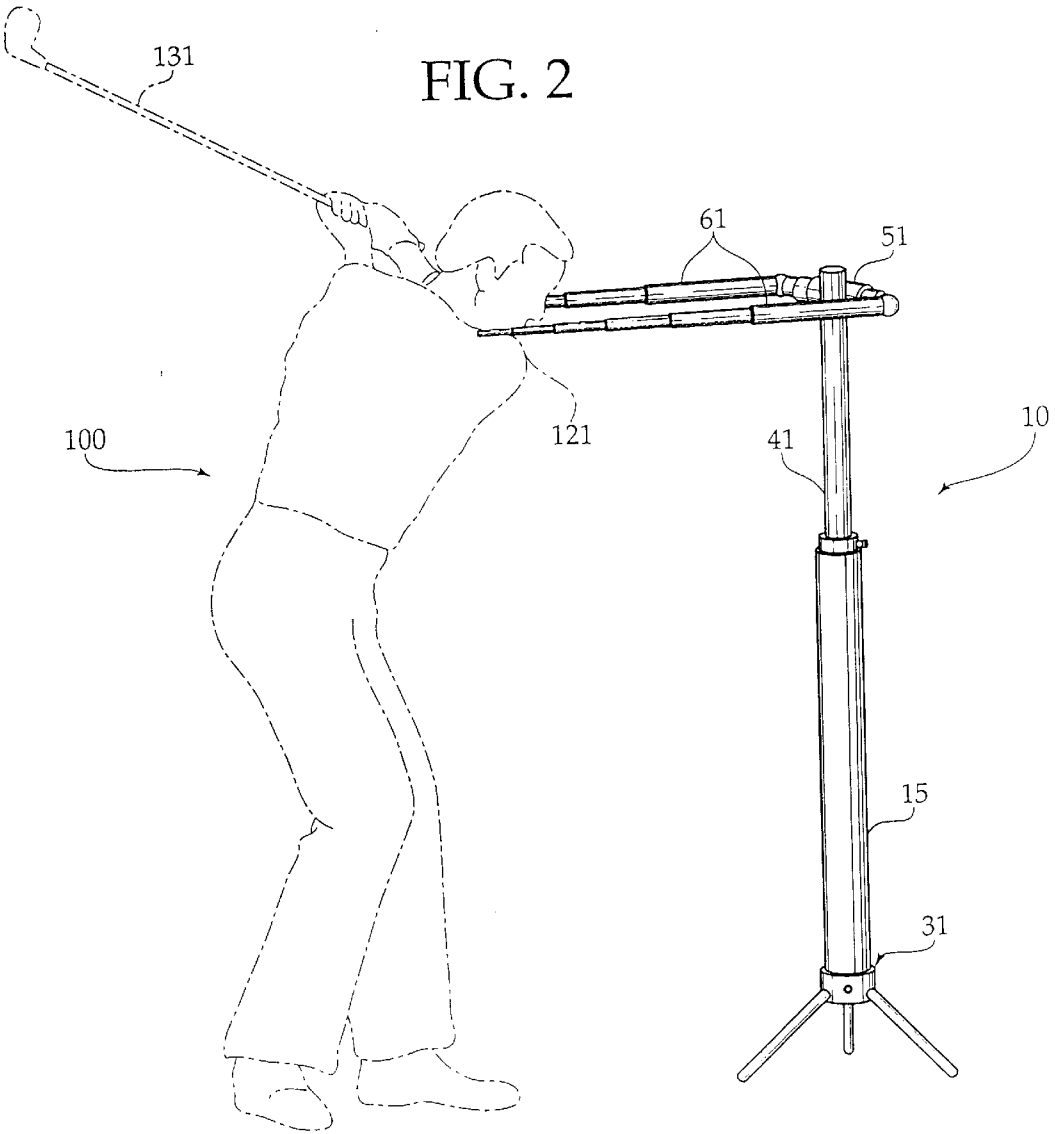
FIG. 2 is a diagrammatic perspective view of the golf swing practice apparatus in use by a golfer.
Figure 3:
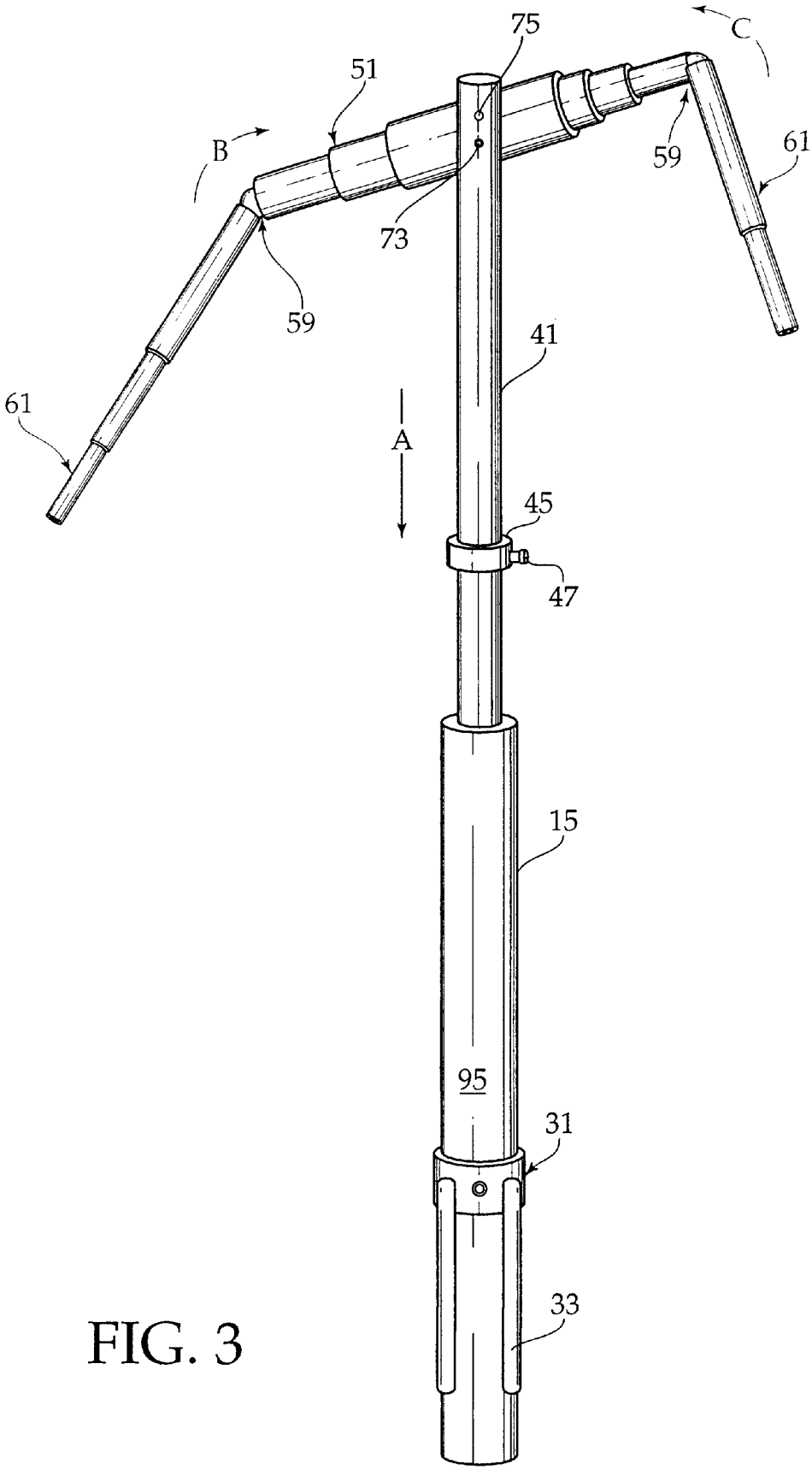
FIG. 3 is a diagrammatic perspective view of the golf swing practice apparatus, showing the various parts being collapsed together for storage.

FIGS. 1–3 disclose a golf swing practice apparatus 10 that allows a golfer 100 to practice his swing with a golf club 131, as shown in FIG. 2.

As shown in FIG. 1, the golf swing practice apparatus 10 has an elongated housing 15, which has a hollow interior. The housing 15 has a bottom edge. A tripod stand 31 is secured on the bottom edge of the housing 15.

The tripod stand 31 comprises a plurality of legs 33 and a donut-shaped sleeve 35. The legs 33 are hingeably mounted from the donut-shaped sleeve 35 so that the legs 33 may be pushed downward such that they lie in on the exterior surface 95 of the housing 15, as shown in FIG. 4.

The sleeve 35 has a tightening means 37 that allows the users to tightly fasten the sleeve 35 onto the exterior surface 95. It is envisioned that when the golf swing practice apparatus 10 is not in use, the tightening means 37 is loosened, the tripod stand 31 is moved upward on the housing 15, the legs 33 are pushed downward so that they lie on top of the exterior surface 95, and the tightening means 37 may be tightened back to ensure that the sleeve 35 remains secured on the housing 15. According to the invention, the tightening means 37 may be a bolt, a screw or the like, wherein the sleeve 35 has an opening that allows the tightening means 37 to pass therethrough and engage with the exterior surface 95 of the housing 15.

The golf swing practice apparatus 10 has an upper rod 41 that extends vertically from within the housing 15. The rod 41 is provided with a rod securement means 44, which comprises an upper sleeve 45 that has an upper tightening means 47 to tightly secure the upper sleeve 45 to the rod 41. The rod securement means 44 ensures that the rod 41 remains in place on top of the housing 15. According to the invention, the upper tightening means 47 may be loosened and the rod securement means 44 moved upward or downward along the length of the rod 41 to adjust the rod's 41 height relative to the ground.

The rod 41 has a top end that is pivotably mounted with an extension 51 that lies horizontal to the ground when the golf swing practice apparatus 10 is in use (FIG. 2). The extension 51 has a center that is secured to the rod 41 by a pin 73 so that the extension 51 can rotate circularly around the pin 73. The extension 51 comprises an extension hole and the rod has a securement hole 75 (FIG. 3). To secure the extension 51 to the rod 41 and ensure that the extension 51 is horizontal to the ground, the extension hole and the securement hole 75 are lined up and a pin 71 is inserted through the lined up holes.

The extension 51 is comprised of a plurality of telescopic segments 57 that collapse into each other. Each telescopic segment 57 is cylindrical in shape and is hollow in its interior portion.

The extension 51 has two ends 59 that lie opposite from each other. Each of the ends 59 has a swing arm 61 pivotably mounted thereon. As shown in FIG. 2, the swing arms 61 lie horizontal to the ground and extend at approximately a right angle from the ends 59 of the extension 51 when the golf swing practice apparatus 10 is in use. Similar to the extension 51, the swing arms 61 comprise a plurality of telescopic segments 57 that collapse into each other.

As shown in FIGS. 1–3, the swing arms 61 are mounted to the ends 59 of the extension 51 by a ball and socket assembly that is known to the prior art. According to the invention, each end 59 has a semi-spherical socket, while each swing arm has a ball that is secured within the sockets. The ball socket has sufficient friction to ensure that the swing arms 61 can be held at right angles from the ends 59 of the extension 51.

To allow storage of the golf swing practice apparatus 10, the swing arms 61 may be rotated in the directions of the arrows B, C, as shown in FIG. 3. Thus, the swing arms 61 are aligned with the extension 51, such that the swing arms 61 and the extension 51 lie in a straight line. Once the extension 51 and the swing arms 61 lie in a straight line, the telescopic segments 57 may be pushed together to reduce the lengths of the extension 51 and the swing arms 61 and facilitate storage.

Referring now to FIG. 3, it is possible to fold together the golf swing practice apparatus 10 to facilitate storage. As noted above, the tripod stand 31 may be moved upward on the housing 15 and the legs 33 are placed on top of the exterior surface 95 of the housing 15. The extension 51 and the swing arms 61 are lined up by moving the swing arms 61 along arrows B, C. The extension 51 and the swing arms 61 are compressed by collapsing the telescopic segments 57 into each other. The pin 75 is removed, or depressed, from the extension hole and the securement hole 75, and the extension 51 is rotated such that it is parallel to the rod 41. The upper sleeve 45 is loosed and the rod 41 is pushed into the focusing 15 as shown by arrow A, and the golf swing practice apparatus 10 may be stored away.

To set up the golf swing practice apparatus 10 for practice, the golfer 100 pulls the rod 41 out of the housing 15 and secures the upper sleeve 45 such that the extension 51 and the swing arms 61 are a few inches over the golfer's shoulders 121. The extension 51 is secured to the rod by inserting the pin 75, or locking device, in the lined up extension hole and the securement hole 75. The golfer 100 secures the swing arms 61 at right angles from the extension, as shown in FIG. 2. The ends 53 of the extension 51 are pulled in a direction away from the rod 41, such that the golfer's 100 head 122 lies between the two swing arms 51, and the golfer 100 is ready to practice his swing freely with the golf club 131.

The golfer 100 places the golf ball on the ground between the two swing arms 61, and swings his club 131 at the ball while ensuring that his head 122 lies within the swing arms 61, and avoid contact therewith. Thus, to avoid hitting the golf swing arms 61, the golfer 100 is forced to swing the club 131 in a smooth continuous manner with a motion to appropriately hit the golf ball.

Many specific details contained in the above description merely illustrate some preferred embodiments and should not be construed as a limitation on the scope of the invention. Accordingly, many other variations are possible within the spirit of the present invention, limited only by the scope of the appended claims and their legal equivalents.

What is claimed is:

1. A golf swing practice apparatus for allowing a golfer to freely practice his golf swing and motion with a golf club, wherein the golf swing practice apparatus is placed on a flat ground, the golf swing practice apparatus comprising:

an elongated housing having a bottom edge;

a tripod stand mounted near the bottom edge of the housing;

a vertical rod mounted within said housing, such that said rod extends upward from the housing;

an extension having a pair of ends opposite to each other and a center, said extension pivotably mounted to said rod at the center wherein the extension is mounted exteriorly to an upper end of the rod; and a pair of swing arms pivotably mounted from said ends of said extension, such that the swing arms may be extended at a right angle from the extension.

2. The golf swing practice apparatus of claim 1, wherein the extension is pivotably mounted to the rod by a pin.

3. The golf swing practice apparatus of claim 2, wherein the tripod stand comprises a plurality of legs and a donut-shaped sleeve, wherein said legs are hingeably mounted to said sleeve.

4. The golf swing practice apparatus of claim 2, wherein said extension is provided with an extension hole and the rod has a securement hole, such that said extension hole and said securement hole are lined up and a key inserted therethrough to secure said extension in a horizontal plane relative to the ground.

5. The golf swing practice apparatus of claim 4, wherein the tripod stand comprises a plurality of legs and a donut-shaped sleeve, wherein said legs are hingeably mounted to said sleeve.

6. The golf swing practice apparatus of claim 5, wherein the sleeve has a tightening means to fasten said sleeve on said housing.

7. The golf swing practice apparatus of claim 6, wherein the vertical rod is provided with a rod securement means, the rod securement means comprising an upper sleeve and an upper tightening means that tightens the upper sleeve to the rod, wherein the rod securement means ensures that the rod remains in place on top of the housing.

8. The golf swing practice apparatus of claim 7, wherein said extension comprises a plurality of telescopic sections, such that said extension may be collapsed together to facilitate storage thereof.

9. The golf swing practice apparatus of claim 8, wherein said swing arms comprises a plurality of telescopic sections, such that said swing arms may be collapsed together to facilitate storage thereof.

10. The golf swing practice apparatus of claim 6, wherein said swing arms comprises a plurality of telescopic sections, such that said swing arms may be collapsed together to facilitate storage thereof.

11. The golf swing practice apparatus of claim 10, further comprising a ball socket that pivotably secures the swing arms to the ends of the extension, such that the swing arms may be rotated relative to the ends of the extension.

12. The golf swing practice apparatus of claim 11, wherein the ends of the extension are provided with a semi-spherical socket and the swing arms have a ball that is secured within said sockets, which allows the swing arms to be rotated relative to the ends of the extension.

* * * * *